US005497165A

United States Patent [19]

Murakami et al.

[11] Patent Number: 5,497,165

[45] Date of Patent: Mar. 5, 1996

[54] MICROSTRIP ANTENNA

[75] Inventors: Yuichi Murakami, Chiryu; Kiyokazu Ieda, Toyota, both of Japan

[73] Assignee: Aisin Seiki Kabushiki Kaisha, Kariya, Japan

[21] Appl. No.: 386,345

[22] Filed: Feb. 10, 1995

Related U.S. Application Data

[63] Continuation of Ser. No. 62,730, May 18, 1993, abandoned, which is a continuation of Ser. No. 805,985, Dec. 12, 1991, abandoned.

[30] Foreign Application Priority Data

Dec. 14, 1990 [JP] Japan ..... 2-402145
Dec. 14, 1990 [JP] Japan ..... 2-402146

[51] Int. Cl.[6] ..... H01Q 1/38

[52] U.S. Cl. ..... 343/700 MS; 343/846; 343/848

[58] Field of Search ..... 343/700 MS File, 343/846, 848, 829, 830, 831; H01Q 1/38

[56] References Cited

U.S. PATENT DOCUMENTS

| | | | |
|---|---|---|---|
| 4,125,839 | 11/1978 | Kaloi | 343/700 MS |
| 4,167,010 | 9/1979 | Kerr | 343/700 MS |
| 4,379,296 | 4/1983 | Farrar et al. | 343/700 MS |
| 4,751,513 | 6/1988 | Daryoush et al. | 343/700 MS |
| 5,021,795 | 6/1991 | Masiulis | 343/700 MS |
| 5,245,745 | 9/1993 | Jensen et al. | 343/700 MS |
| 5,315,753 | 5/1994 | Jensen et al. | 343/700 MS |

FOREIGN PATENT DOCUMENTS

| | | |
|---|---|---|
| 60-36641 | 8/1985 | Japan . |
| 60-244103 | 12/1985 | Japan . |
| 61-71702 | 4/1986 | Japan . |
| 62-131609 | 6/1987 | Japan . |
| 63-129311 | 8/1988 | Japan . |

*Primary Examiner*—Donald T. Hajec
*Assistant Examiner*—Hoanganh Le
*Attorney, Agent, or Firm*—Sughrue, Mion, Zinn, Macpeak & Seas

[57] ABSTRACT

A microstrip antenna comprises a dielectric plate having a thickness to be sufficiently shorter than a free space wavelength, a rectangular radiation conductive plate member mounted on one surface of the dielectric plate and set to be constructed that each side ranges from ¼ of guide wavelength through ½ of guide wavelength, and a pair of opposed parts each of which is extended from each side of the rectangular radiation conductive plate member and each side of parts is less than ¼ of guide wavelength.

6 Claims, 7 Drawing Sheets

MICROSTRIP ANTENNA

This is a continuation of application Ser. No. 08/062,730 filed on May 18, 1993, now abandoned, which is a continuation of parent application Ser. No. 07/805,985 filed on Dec. 12, 1991, now abandoned.

BACKGROUND OF THE INVENTION

1. Field of the Invention

This invention relates to a microstrip antenna.

2. Description of the Prior Art

In general, a microstrip antenna is requested to meet or satisfy three major requirements—the matching ability, the directivity and the performance including the gain and the efficiency. In light of this, there have been provided microstrip antennas. However, any one of them fails to meet or satisfy the foregoing requirements without the enlargement of the antenna per se.

SUMMARY OF THE PRESENT INVENTION

It is, therefore, a primary object of the invention to provide a microstrip antenna which obviates the above-described drawback.

In order to attain the foregoing objects, according to the present invention, a microstrip antenna is comprised of a dielectric plate having a thickness to be sufficiently shorter than a free space wavelength, a rectangular radiation conductive plate member mounted on one surface of the dielectric plate and set to be constructed that each side ranges from ¼ of guide wavelength through ½ of guide wavelength, and a pair of opposed parts each of which is extended from each side of the rectangular radiation conductive plate member and each side of parts is less than ¼ of guide wavelength.

DETAILED DESCRIPTION OF PREFERRED EMBODIMENTS OF THE INVENTION

Figure 1:
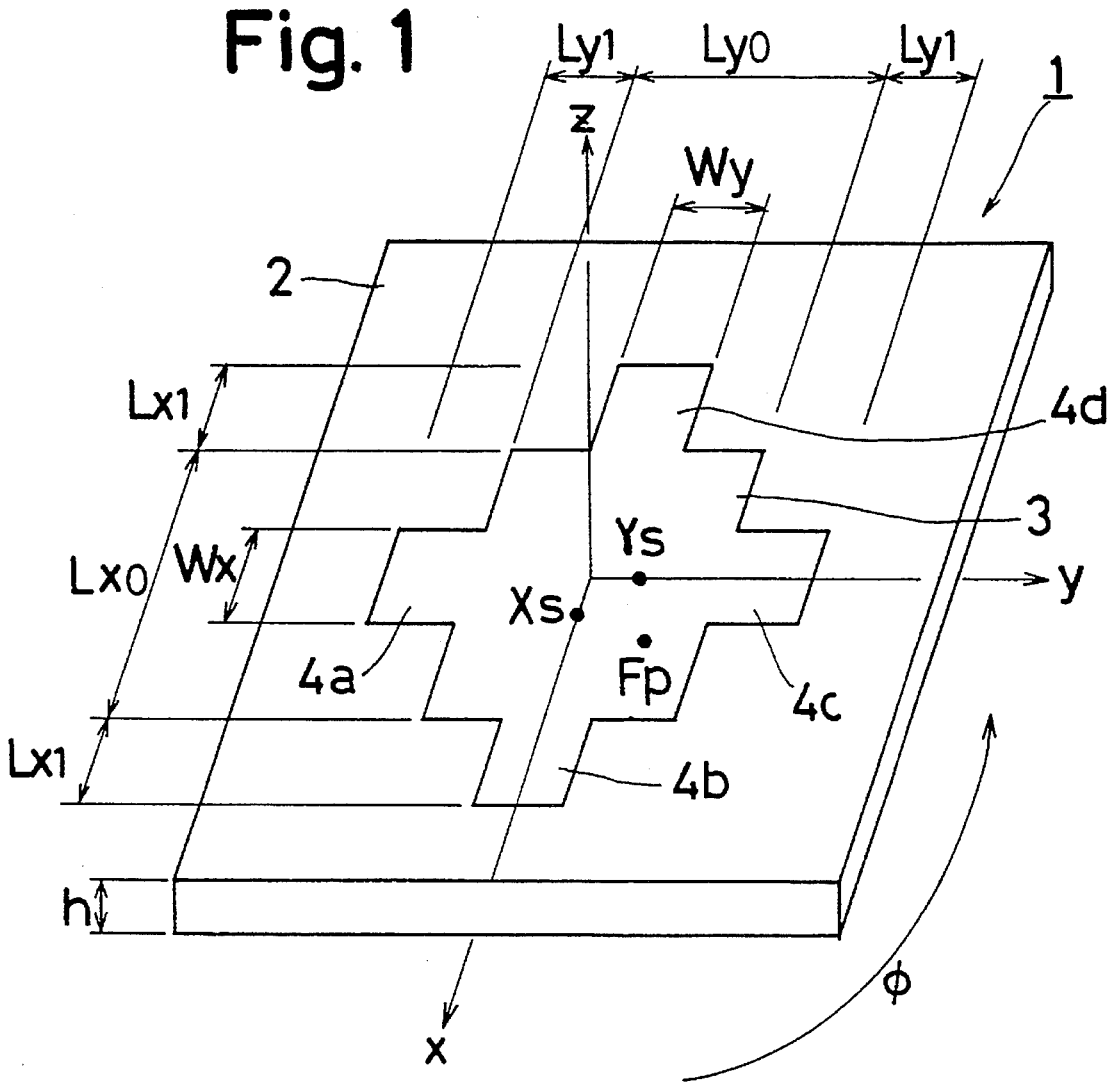
FIG. 1 is a perspective view of a microstrip antenna of the invention.

Referring to FIG. 1, a microstrip antenna MS includes a dielectric plate 2 which has a radiation conductive plate member 3 and a grounding conductive plate (not shown) on one side and the other side, respectively. The dielectric plate 2 has a thickness of h which is sufficiently shorter than a free space wavelength of λ 0 and a dielectric constant of Er. The dielectric plate 2 has a length of Lx0 in the X-direction and a length of Ly0 in the Y-direction.

The radiation conductive plate member 3 has a first rectangular part 4*b* and a second rectangular part 4*d* which extend outwardly from an upper periphery and a lower periphery of the member 3. The plate member 3, the first rectangular part 4*b* and the second rectangular part 4*d* having a common X axis center line. The radiation conductive plate member 3 also has a third rectangular part 4*a* and a fourth rectangular part 4*c* which extend outwardly from a left periphery and a right periphery of the member 3. The plate member 3, the third rectangular part 4*a* and the fourth rectangular part 4*c* have a common Y axis center line. The first rectangular part 4*b*, second rectangular part 4*d*, third rectangular part 4*a* and fourth rectangular part 4*c* has a length of Lx1 (Wy), Lx1 (Wy), Wx (Ly1) and Wx (Ly1) in the X-direction (Y-direction).

Figure 2:
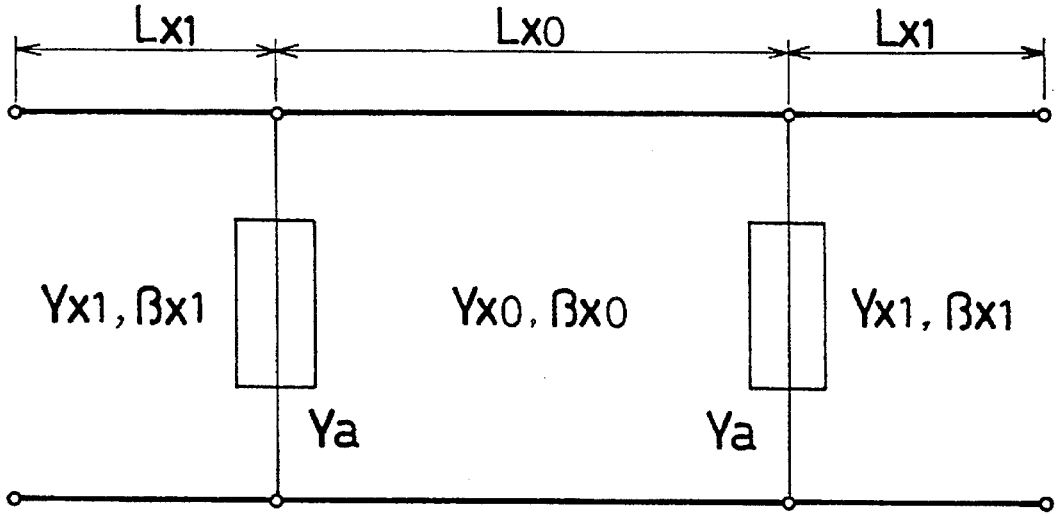
FIG. 2 is a circuit which is in equivalent to a microstrip antenna in X-direction.

A resonance condition at which imaginary number becomes 0 can be obtained by an equivalent circuit which is shown in FIG. 2. In FIG. 2, it is defined that Yx0 and Yx1 are characteristic admittances against the lengths Ly0 and Wy, respectively and βx0 and βx1 are phase constants of the characteristic admittances Yx0 and Yx1, respectively. In this embodiment, a radiation admittance Ya is smaller than or equal to each of Yx0 and Yx1. The reason is tat the thickness h of the dielectric member 3 is sufficiently smaller than the free space wavelength λ 0. Thus, for letting the later discussion more simple, Ya is set to be 0. Then, the following formula is used which represents the resonant condition under which imaginary number of Yinx is 0.

$$\tan(\beta\times 1)(L\times 1) = Y\times 0\cdot\frac{1-\sqrt{1+\tan^2(\beta\times 0)(L\times 0)}}{Y1\cdot\tan(\beta\times 0)(L\times 0)}$$

In the present invention, since λ g /4<Lx0<λ g /2 and 0<Lx1<λ g /4. tan(βx0)(Lx0)<0 and tan(βx1)(Lx1)>0 are obtained.

Figure 3:
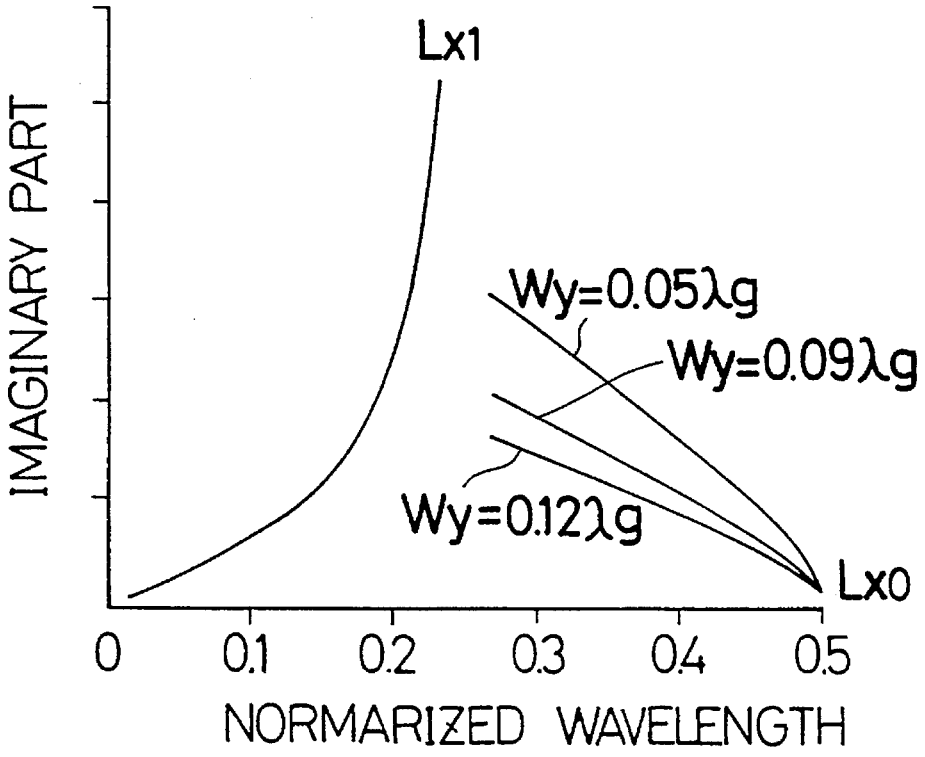
FIG. 3 is a graph illustrating a resonant condition.

Referring to FIG. 3 wherein the foregoing formula is represented in the form of a graph. The horizontal axis shows normalized wavelength of Lx0 and Lx1 by the guide wavelength of λ g. It is also noted that λ g≈λ 0 / $\sqrt{\ }$ Er. The vertical axis shows each of values at both sides of the foregoing formula. If both values become same, the resonant will be made. In the right side of the formula, the characteristic admittance Y1 is included which depends on the width of Wy of each parts 4*b* and 4*d*. As examples of the resonance conditions are shown when Wy=0.05 λ g, 0.09 λ g, and 0.12 λ g. At a conventional basic mode exciting under which Lx0=0.5 λ g, the resonant is made when Lx1=0. Under the condition that Wy=0.05 λ g, when Lx1=0.19 λ g, the resonant is made. Thus, resonant condition is set.

The gain calculated or obtained from a formula of the antenna efficiency×directivity gain. The former is deceased as the dielectric constant increases. In this invention, due to no limitation regarding the antenna efficiency, no disadvantage is generated therein. The latter depends on the magnitude of the member 3.

As to the radiation directivity, in order to obtain a sufficient one, the grounding conductive plate or the dielectric plate member 2 should be twice as each aperture length or distance. In the present invention, the dielectric plate member 3 has a length of 2Lx0 which is shorter that a conventional element length of 0.5 λ g. Thus, the length of the dielectric plate member 2 can be shortened by a deviation between the foregoing lengths. As to the y-direction, in the similar manner, the resonant frequency is determined based on the width of Wx and the length of Ly1 of each part 4*a* and 4*c* and the length of Ly0 of the element 3.

Figure 4:
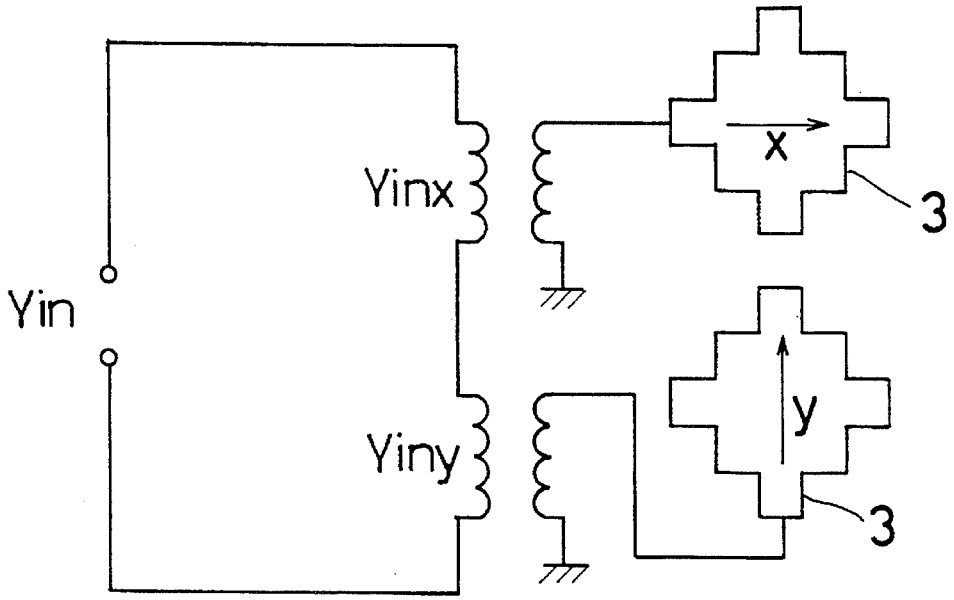
FIG. 4 is an equivalent circuit to an antenna upon diagonal exciting thereof.

For exciting orthogonal mode (x-direction, y-direction), the feeding electric points are on a common diagonal line on the element 3, whose equivalent circuit is shown in FIG. 4. Circular polarization characteristic is set to be evaluated by the axis-ratio and the axis-ratio will establish circular polarization when an input admittance Yinx in the x-direction / Yiny=±j. The radiation directivity is depended on the phase and amplitude of the voltage at the aperture of the end of the element. In this embodiment, at both ends of the element, the phases are opposed and the amplitudes are the same, which results in that the maximum radiation direction under which X>0 is perpendicular to the element.

Figure 5:
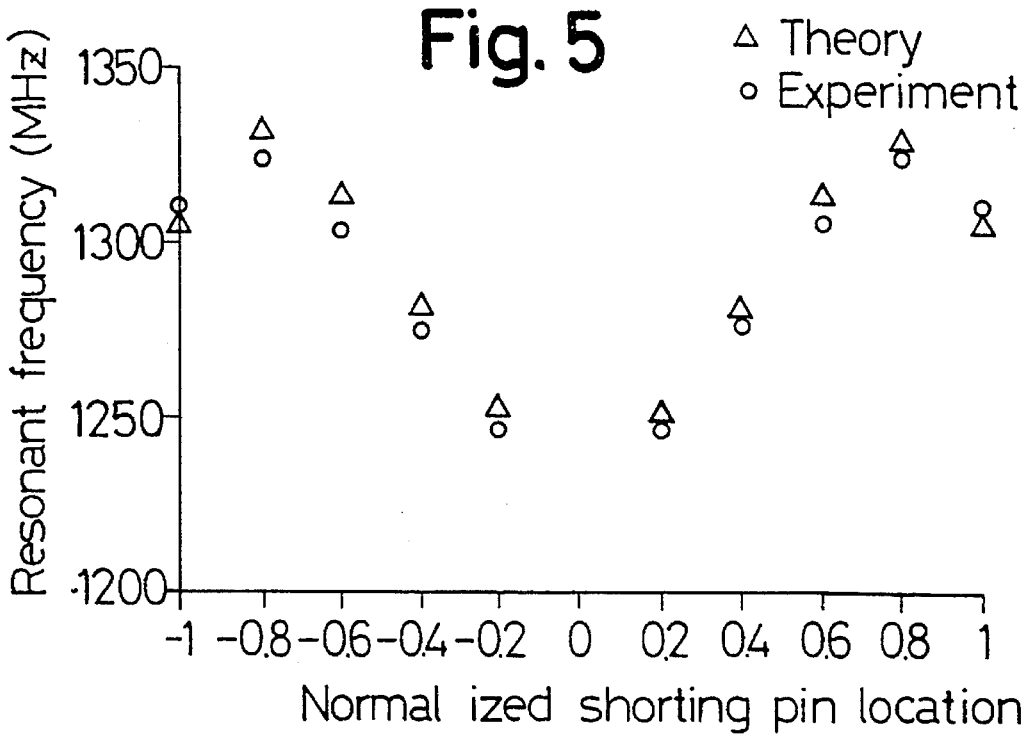
FIG. 5 is a graph showing the relationship between the pin's location and the resonant frequency.

In order to vary the maximum radiation direction, the aperture voltage change is one method therefor. In this embodiment, a pair of pins Xs and Ys are used. That is to say, by differentiating the amplitude at opposite ends of the elements, the maximum direction is set to be tilted. As shown in FIG. 5, the movement of the pin toward the end of the element bring the increase of the resonant frequency. This is based on a report "Theoretical and experimental investigation of a microstrip radiator with multiple linear loads" (Electromagn., Vol. 4, No. 3–4, pp371–385, September 1983) written by W. F. Richard et. al. According to this the closing location of the pin to the end of the element is not desirable. In FIG. 1, the distance between the center of the element 3 and the pin Xs (Ys) is 8 mm (8 mm) and the feeding point Fp is substantially on the diagonal line of the element 3.

An experiment is established for confirming the foregoing operation principle by using Teflon plate member 2 whose dielectric constant Er≈2.5 and setting the following rating. The length Lx0 of the element 3≈0.33 λ g=40 mm. The length Ly0 of the element 3≈0.33 λ g=40 mm. The length Wy≈0.13 λ g=16 mm. The length Lx1≈0.14 λ g=16.5 mm. The length Lxy≈0.14 λ g=17 mm. Each side or periphery of the plate member 2 is 80 mm or is twice that of the element 3.

Figure 6:
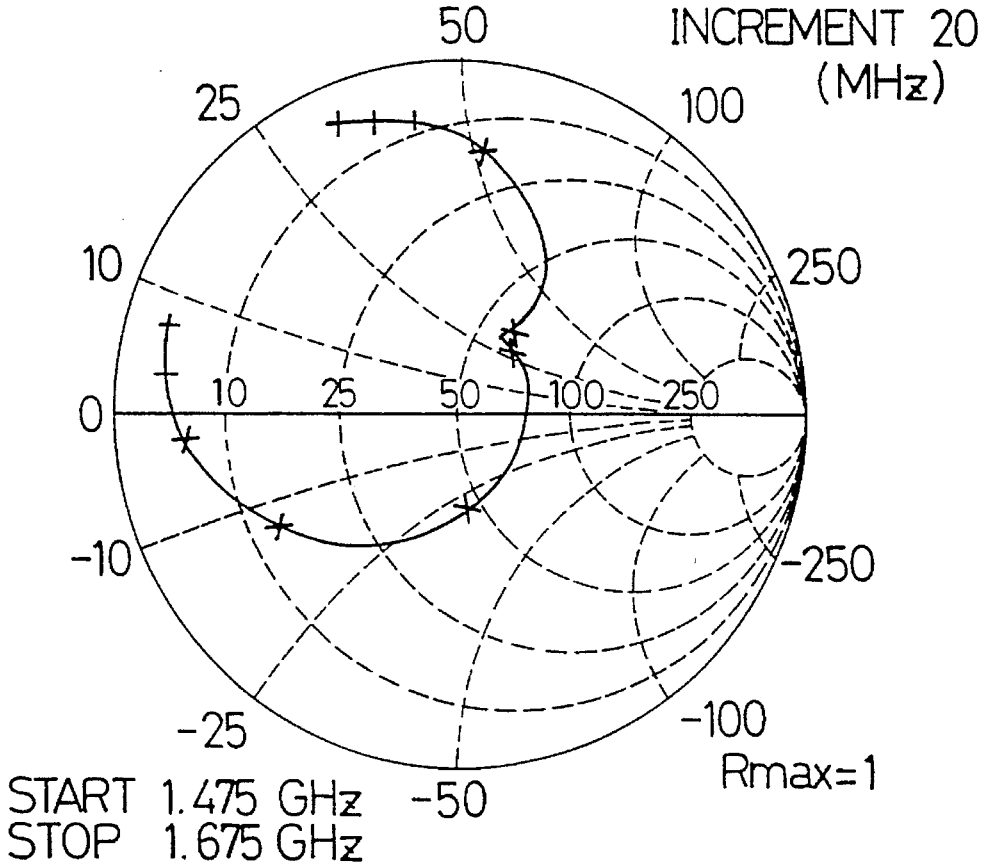
FIG. 6 is a Smith-chart showing a locus of an input impedance of an antenna.
Figure 7:
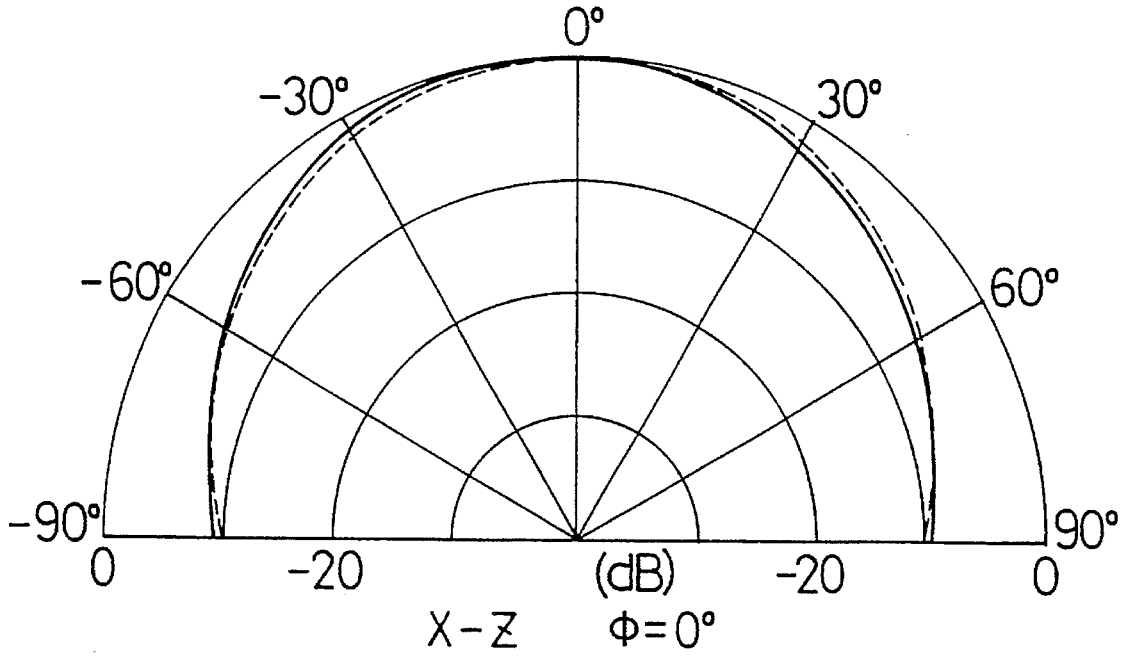
FIG. 7, FIG. 8 and FIG. 9 each show a characteristic of the radiation directivity of an antenna shown in FIG. 1.
Figure 8:
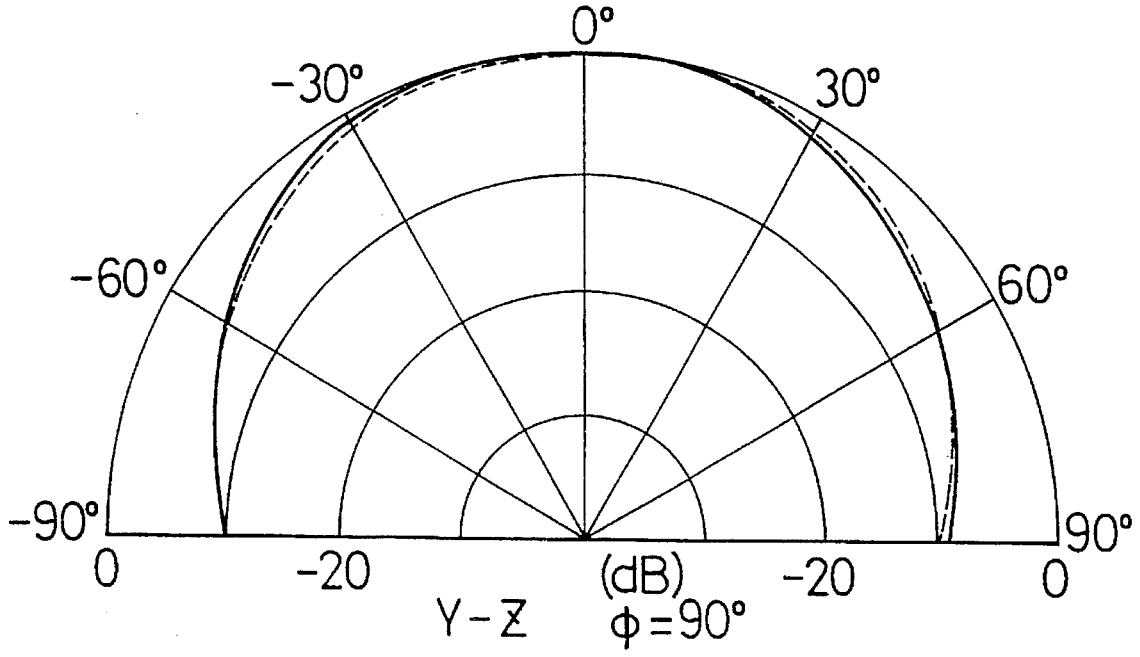
Figure 9:
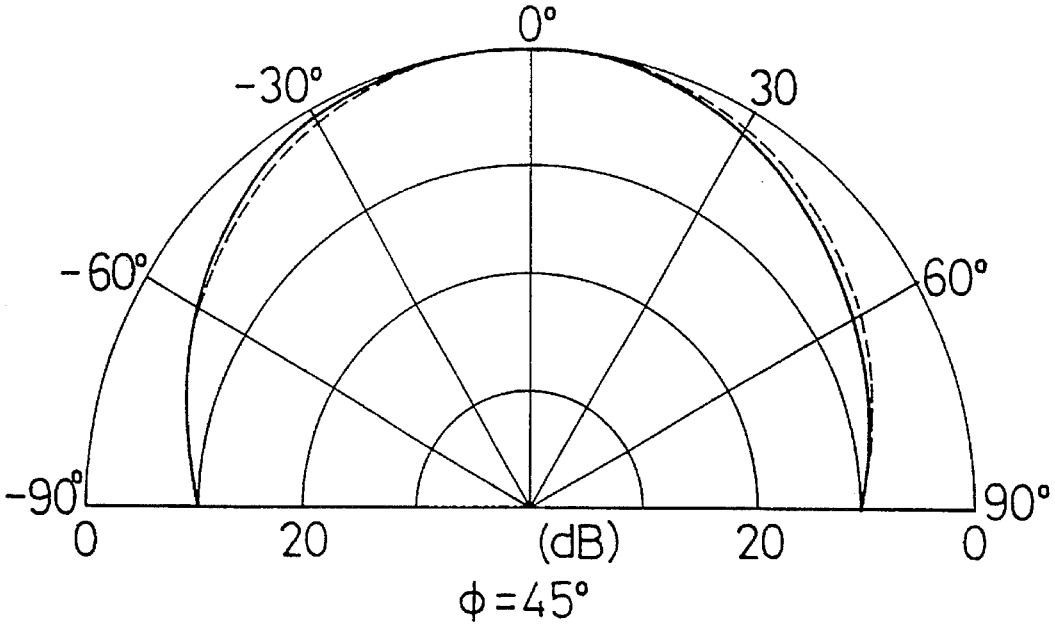

Antenna performance of this embodiment is shown in FIGS. 6, 7, 8 and 9. FIG. 6 shows the trajectory of an input impedance of the antenna 1. Under the design wavelength of λ g≈120 mm, VSWR<2 which reveals the satisfactory matching. Each of FIGS. 7, 8, and 9 shows antenna radiation directivity wherein the characteristic of this embodiment when the pin is tilted is represented by the real line and the characteristic of the conventional antenna is represented by the phantom line.

According to the coordinates in FIG. 1, in the direction of −90 degrees through 0 degree when ϕ=45 degrees which is in the opposite side of the feeding point, the gain is increased about 1 dB in comparison with the conventional antenna. The gain in the maximum radiation is 5.8 dBi.

Figure 10:
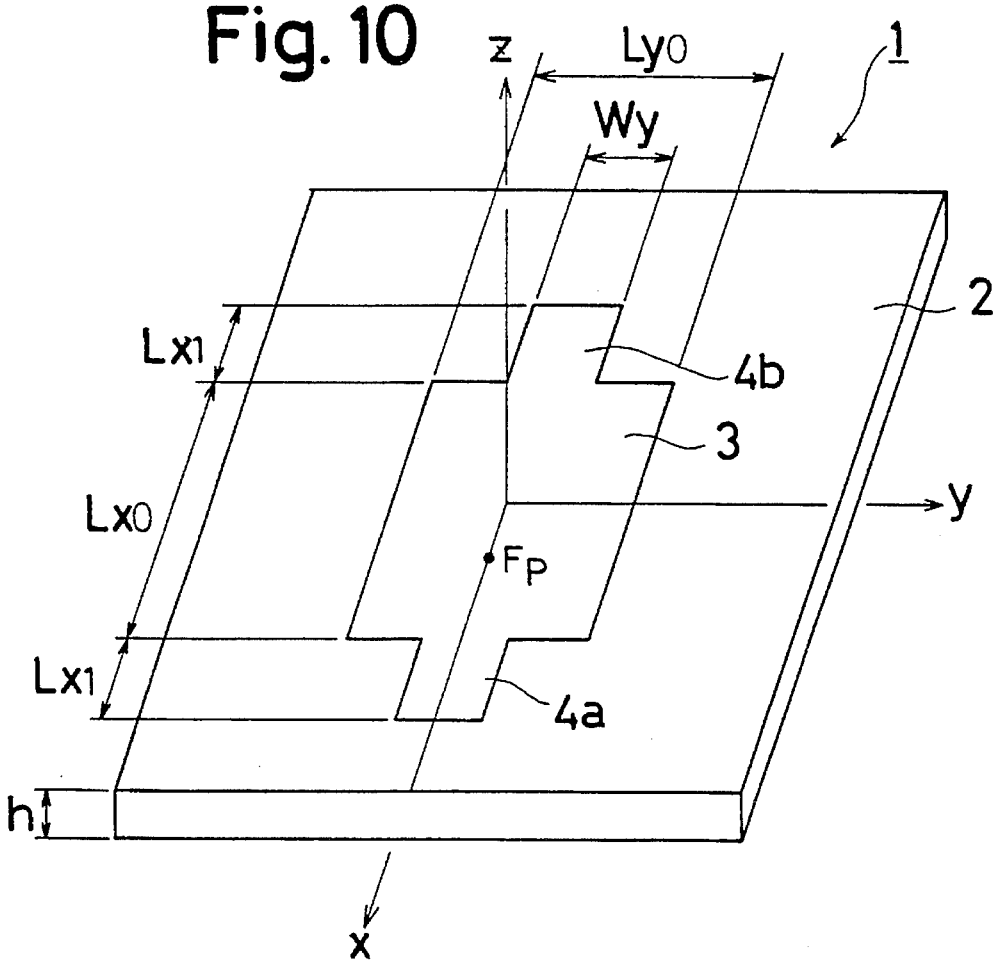
FIG. 10 is a perspective view of another microstrip antenna of the invention.
Figure 11:
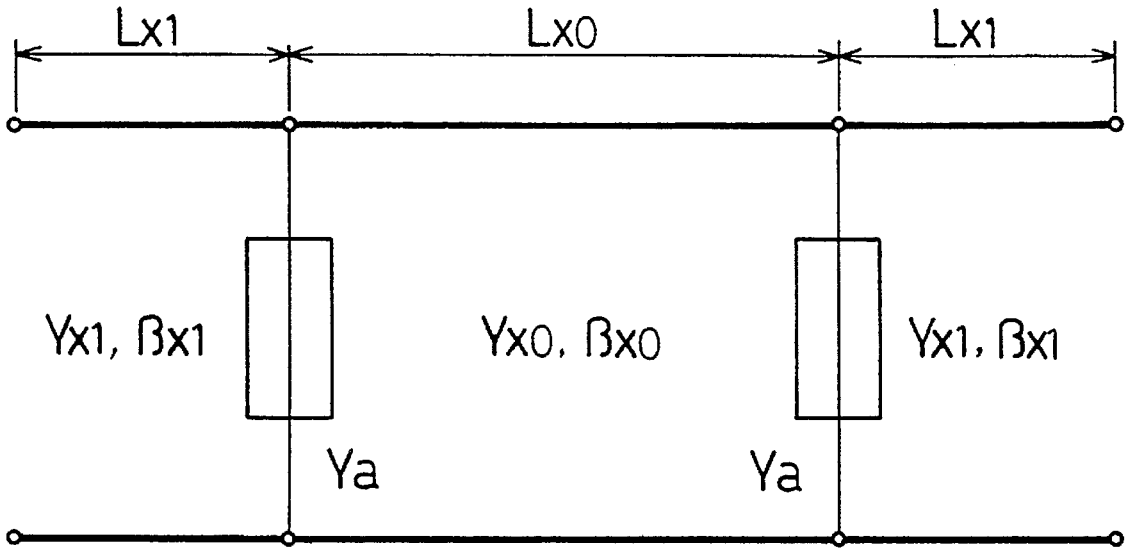
FIG. 11 is a circuit which is in equivalent to a microstrip antenna in X-direction.
Figure 12:
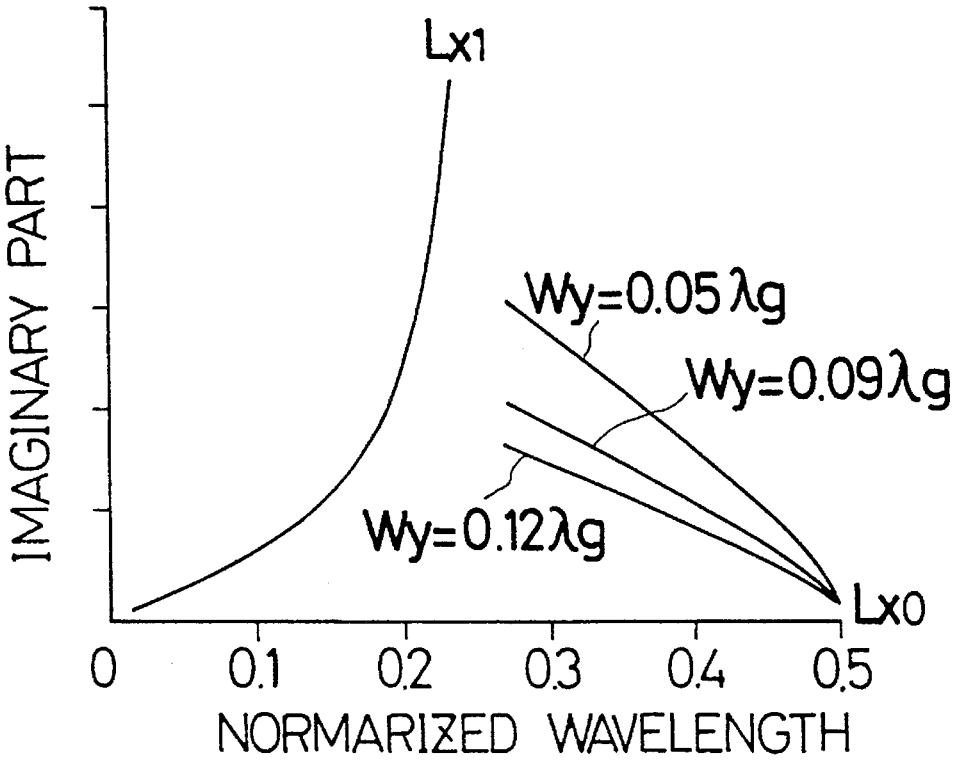
FIG. 12 is a graph illustrating a resonant condition.

In FIG. 10, there is shown another antenna 1 which is a simplified one. That is to say, this antenna 1 is for linear polarization and has a structure similar to the foregoing antenna except that the former has not a second part and a fourth part. In this antenna 1, y-direction exciting is not established. A feeding point Fp is located on a line connecting the pair of opposed parts 4*a* and 4*b*.

An experiment is established for confirming the foregoing operation principle by using Teflon plate member 2 whose dielectric constant Er≈2.5 and setting the following rating. The thickness of the plate member 2 is 3.2 mm. The length Lx0 of the element 3≈0.034 λ g. The length Wy≈0.009 λ g. As a result, Lx1≈0.14 λ g is obtained. It is noted that the feeding point is on the matching point at Ly0/2.

Figure 13:
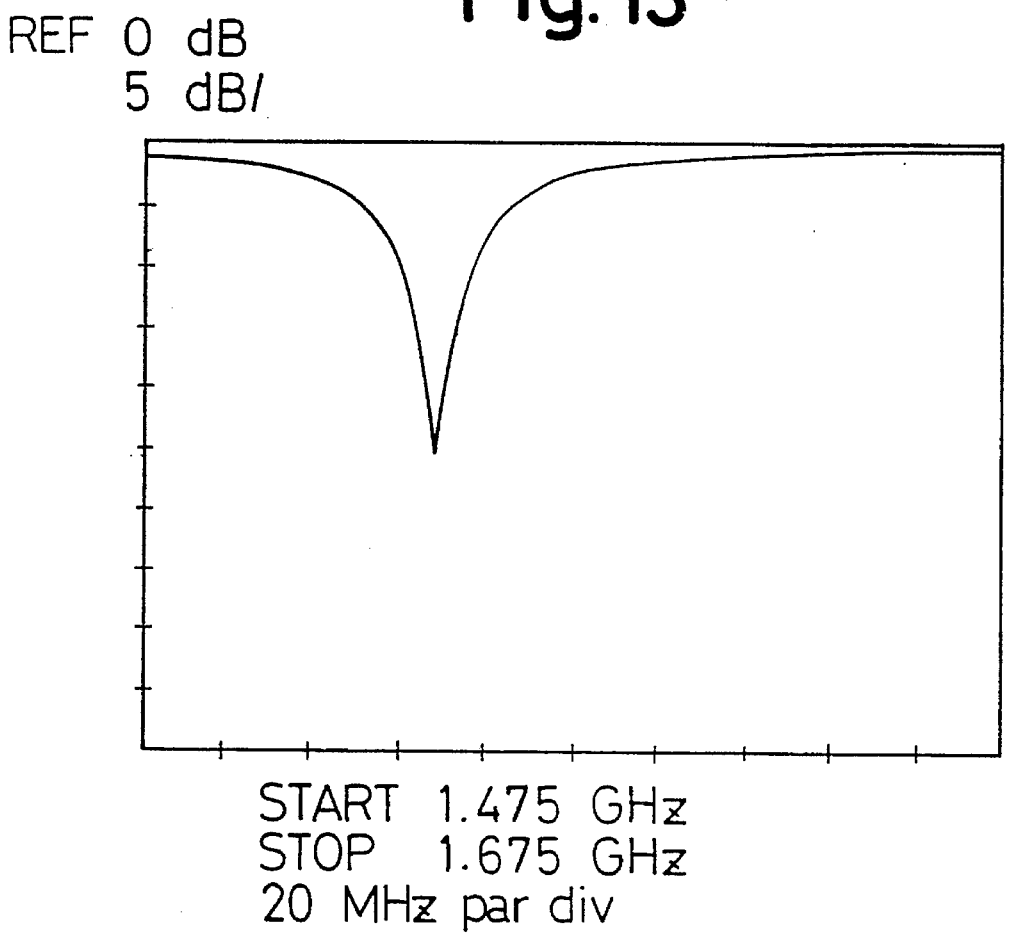
FIG. 13 is a graph showing the relationship between the reflection coefficient and fed frequency to an antenna.
Figure 14:
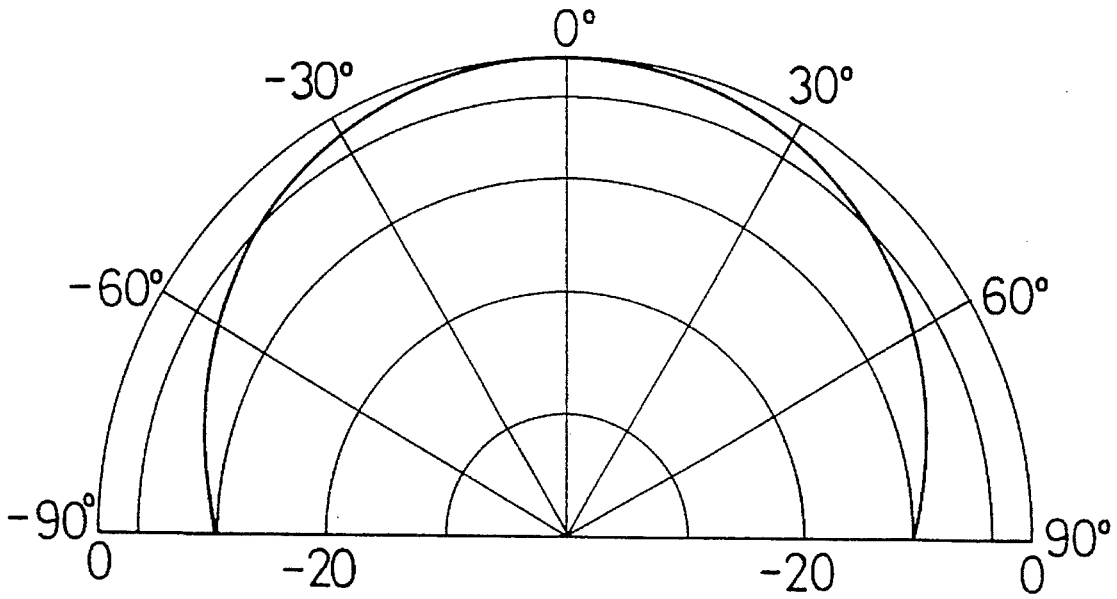
FIG. 14 is a graph showing the radiation directivity of an antenna.

Each of FIGS. 13 and 14 shows antenna performance. In the former, reflection coefficient is illustrated when the fed wave is changed from 1.475 GHz through 1.675 GHz. In the latter, the radiation directivity is shown from which the gain is found to be 6 dBi. Thus, the matching, the radiation directivity and the gain are all satisfactory.

It should be understood that, although the preferred embodiment of the present invention has been described herein in considerable detail, certain modifications, changes, and adaptations may be made by those skilled in the art and that is hereby intended to cover all modifications, changes and adaptations thereof falling within the scope of the appended claims.

What is claimed is:

1. A microstrip antenna for linearly polarized waves comprising:

a dielectric plate having a thickness to be sufficiently shorter than a free space wavelength; p1 a rectangular-shaped radiation conductive plate member defined by four sides and having only one feeding point thereon, said plate member being mounted on one surface of the dielectric plate and each side being longer than ¼ of a guide wavelength and shorter than ½ of a guide wavelength; and a pair of opposed conductive parts each of which is extended from a center portion of each side of said plate member and each side of said parts is less than ¼ of guide wavelength in length for shortening a length of each side of the plate member in comparison with ½ of a guide wavelength and determining the resonant frequency, said feeding point being located on a line connecting said pair of opposed parts.

2. A microstrip antenna according to claim 1, wherein the rectangular radiation conductive plate member is a square one.

3. A microstrip antenna for circularly polarized waves comprising:

a dielectric plate having a thickness to be sufficiently shorter than a free space wavelength;

a rectangular radiation conductive plate member having four sides and having a feeding point thereon mounted on one surface of the dielectric plate with the length of each of its sides being longer than ¼ of a guide wavelength and shorter than ½ of a guide wavelength;

four parts each of which has a side and extends symmetrically from a center portion of a corresponding one of the four sides of said rectangular radiation conductive plate member with each side of said parts having a length less than ¼ of a guide wavelength for shortening a length of each side of the plate member in comparison with ½ of a guide wavelength and determining the resonant frequency, said feeding point being located on a diagonal line of the rectangular radiation conductive plate member; and a pair of pins extending from said rectangular radiation conductive plate and spaced equidistant from a center of said plate on orthogonal center lines thereof for tilting the directivity of the antenna.

4. A microstrip antenna as set forth in claim 3, wherein the rectangular radiation conductive plate member is square.

5. A microstrip antenna for linearly polarized waves comprising:

a dielectric plate having a thickness to be sufficiently shorter than a free space wavelength;

a rectangular-shaped radiation conductive plate member defined by four sides and having a feeding point thereon, said plate member being mounted on one surface of the dielectric plate and each side being longer than ¼ of a guide wavelength and shorter than ½ of a guide wavelength; and a pair of opposed conductive parts each of which is extended from a center portion of each side of the rectangular radiation conductive plate member and each side of said parts is less than ¼ of guide wavelength in length for determining the resonant frequency, said feeding point being located on a line connecting said pair of opposed parts.

6. A microstrip antenna for circularly polarized waves comprising:

a dielectric plate having a thickness to be sufficiently shorter than a free space wavelength;

a rectangular radiation conductive plate member having four sides and having a feeding point thereon mounted on one surface of the dielectric plate with the length of each of its sides ranging from ¼ of a guide wavelength through ½ of a guide wavelength;

four parts each of which has a side and extends symmetrically from a center portion of a corresponding one of the four sides of said rectangular radiation conductive plate member with each side of said parts having a length less than ¼ of a guide wavelength for determining the resonant frequency; and a pair of pins extending from said rectangular radiation conductive plate and spaced equidistant from a center of said plate on orthogonal center lines thereof for tilting the directivity of the antenna.

* * * * *